US008714499B2

(12) United States Patent
Schwartz et al.

(10) Patent No.: US 8,714,499 B2
(45) Date of Patent: May 6, 2014

(54) ADJUSTABLE FOOT FOR FURNITURE

(75) Inventors: David Schwartz, Lake Saint Louis, MO (US); Larry Hale, Warrenton, MO (US)

(73) Assignee: Ameriwood Industries, Inc., Wright City, MO (US)

( * ) Notice: Subject to any disclaimer, the term of this patent is extended or adjusted under 35 U.S.C. 154(b) by 0 days.

(21) Appl. No.: 13/423,939

(22) Filed: Mar. 19, 2012

(65) Prior Publication Data

US 2013/0240688 A1 Sep. 19, 2013

(51) Int. Cl.
*F16M 11/24* (2006.01)

(52) U.S. Cl.
USPC ..... 248/188.2; 248/649

(58) Field of Classification Search
USPC ..... 248/188.2, 188.4, 649, 650, 677
See application file for complete search history.

(56) References Cited

U.S. PATENT DOCUMENTS

| | | | | |
|---|---|---|---|---|
| 5,653,417 | A * | 8/1997 | DeBarber et al. | 248/688 |
| 6,027,086 | A | 2/2000 | Heitlinger et al. | |
| 6,478,270 | B2 | 11/2002 | Parisi et al. | |
| 7,118,081 | B2 * | 10/2006 | Smith et al. | 248/188.2 |
| 7,137,604 | B2 | 11/2006 | Fitzgerald | |
| 7,290,741 | B1 * | 11/2007 | Cox et al. | 248/188.4 |
| 7,762,506 | B2 | 7/2010 | Beshore | |
| 8,002,224 | B2 | 8/2011 | Hamann | |
| 8,118,379 | B2 * | 2/2012 | Hong et al. | 312/351.3 |
| 2003/0025051 | A1 * | 2/2003 | MacDonald | 248/188.4 |
| 2010/0039010 | A1 * | 2/2010 | Hong et al. | 312/351.3 |

FOREIGN PATENT DOCUMENTS

| | | | |
|---|---|---|---|
| EP | 1118289 | A | 7/2001 |
| JP | 08-256842 | A | 10/1996 |
| KR | 10-2011-0072511 | A | 6/2011 |
| KR | 20-2011-0005693 | U | 6/2011 |

OTHER PUBLICATIONS

International Search Report, International Application No. PCT/US12/29818, mailed on Feb. 27, 2013, 11 pages.

* cited by examiner

*Primary Examiner* — Steven Marsh
(74) *Attorney, Agent, or Firm* — Lewis, Rice & Fingersh, L.C.

(57) ABSTRACT

This invention relates to an adjustable foot support including a mount housing and lower housing. The mount housing is configured to be externally mounted to a piece of furniture and includes an internal, threaded column. The lower housing also includes an internal threaded column with the column configured to mate with the mount housing.

12 Claims, 6 Drawing Sheets

ADJUSTABLE FOOT FOR FURNITURE

BACKGROUND OF THE INVENTION

1. Field of the Invention

This disclosure relates to adjustable foot supports, and more particularly, to adjustable foot supports for furniture.

2. Description of Related Art

By nature, the floor upon which furniture generally rests is never truly level. Furniture, once placed in its final resting spot, however, needs to be in a level, stable position—lest you are left with wobbly furniture. The classic example is a wobbly table that annoys those seated around it and can even result in objects sliding off the table. Moreover, an uneven/unlevel cabinet often causes interference between the hinges and the associated doors and the sliders and the associated drawers, resulting in non-functional compartments within the cabinet. To level furniture, adjustment between the surface (floor) and furniture is needed at: front-to-back of the furniture, side-to-side of the furniture, and cross-corner of the furniture. In other words, all surface points of the furniture may be need to be adjusted to level the furniture. Thus, leveling of the furniture can only be accomplished by using multiple points of adjustment.

Leveling is generally done by placing height-adjustable foot supports between the furniture and the resting surface (floor). The use of multiple-independent adjustment points across a given area eliminates the racking effect (i.e., interference and non-functional doors and drawers) on the cabinet caused by an uneven floor. Additionally, leveling becomes very important not just for proper function of each cabinet, but also for stability and proper alignment when cabinets are placed side-by-side to ensure that adjacent work surfaces and counter tops are even and level—and the larger the cabinet, the greater the range of adjustment is required.

Commercially available adjustable feet on the market have several characteristics that make them impractical for use in many applications, and particularly in the ready-to-assemble (RTA) furniture industry. Many styles of adjustable feet use a standard, machine-threaded steel rod that requires an additional threaded nut to be inserted into a fixed location on the furniture cabinet. This type of adjustable foot support typically requires a tool to adjust and is visually unappealing. Other types of adjustable feet are constructed of plastic material, but generally only support small loads. Moreover, the mounting of these plastic feet do not comply with high speed European 32-mm boring machines used by the RTA furniture industry. Accordingly, there is a need for an adjustable foot that has a large range of adjustment, that meets increased performance and load requirements, that complies the RTA furniture industry mounting applications, that can be adjusted without the use of tools, and which also has an aesthetic appearance at an economical price.

SUMMARY OF THE INVENTION

The following is a summary of the invention in order to provide a basic understanding of some aspects of the invention. This summary is not intended to identify key or critical elements of the invention or to delineate the scope of the invention. The sole purpose of this section is to present some concepts of the invention in a simplified form as a prelude to the more detailed description that is presented later.

Described herein, among other things, are adjustable foot supports for furniture comprising: a lower housing comprising a sidewall and an end wall connected to the sidewall, the sidewall and end wall defining an internal space of the lower housing; a first column positioned within the internal space and extending from the end wall of the lower housing, the first column being spaced apart from the sidewall of the lower housing, the first column having screw threads thereon; a mount housing configured to be attached to a piece of furniture, the mount housing comprising a sidewall and an end wall connected to the sidewall; and a second column positioned within the mount housing and extending from the end wall of the mount housing, the second column spaced apart from the sidewall of the mount housing, the second column having screw threads sized and shaped to mate with the screw threads of the first column.

In certain embodiments, the adjustable foot further comprises a mounting hole on the end wall of the mount housing. The second column also may be hollow and may define an internal space of the second column with the mounting hole extending into the internal space of the second column. At least three mount holes also may be included on the end wall of the mount housing, and in some embodiments, the distance between the first mounting hole and the second and third mounting holes may be approximately 32 millimeters.

In other embodiments, flanges can extend off the end wall of the mount housing perpendicular to the sidewall of the mount housing. These flanges include mounting holes in some embodiments.

In some embodiments, the mount housing is positioned within the internal space of the lower housing when the screw threads of the second column are mated with the screw threads of the first column. In other embodiments, the lower housing, first column, mounting housing, and second column are constructed of a polymeric material.

Also disclosed herein is an adjustable foot support for furniture comprising: a lower housing comprising a sidewall and an end wall connected to the sidewall, the sidewall and end wall defining an internal space of the lower housing and creating an opening; a first column positioned within the internal space and extending from the end wall of the lower housing, the first column being spaced apart from the sidewall of the lower housing, the first column having screw threads thereon; a mount housing comprising a sidewall and an end wall connected to the sidewall; and a second column positioned within the mount housing and extending from the end wall of the mount housing, the second column spaced apart from the sidewall of the mount housing, the second column having screw threads sized and shaped to mate with the screw threads of the first column. In this embodiment, the mount housing is positioned within the internal space of the lower housing when the screw threads of the second column are mated with the screw threads of the first column.

In some embodiments, the threads of the first column are on the exterior of the first column. The threads of the second column also may be on the interior of the second column. In other embodiments, the first column is shorter than the sidewall of the first column. The second column can also be longer than the sidewall of the lower housing.

In certain embodiments, the exterior of the sidewall of the mount housing is fluted. A portion of the sidewall of the lower housing also may be fluted. In another embodiment, the lower housing is tapered with the diameter at the end wall greater than the diameter of the opening of the lower housing. A cap can also be configured to be removably attached to the tapered lower housing.

Also disclosed herein is an adjustable apparatus comprising: a piece of furniture; and an adjustable foot support attached to the furniture. In this embodiment, the adjustable foot support comprises: a lower housing comprising a sidewall and an end wall connected to the sidewall, the sidewall and end wall defining an internal space of the lower housing; a first column positioned within the internal space and extending from the end wall of the lower housing, the first column being spaced apart from the sidewall of the lower housing, the first column having screw threads thereon; a mount housing mounted to the piece of furniture, the mount housing comprising a sidewall and an end wall connected to the sidewall, the end wall being configured for mounting the mount housing to the piece of furniture; and a second column positioned within the mount housing and extending from the end wall of the mount housing, the second column spaced apart from the sidewall of the mount housing, the second column having screw threads sized and shaped to mate with the screw threads of the first column.

In some embodiments, the mount housing is positioned within the internal space of the lower housing when the screw threads of the second column are mated with the screw threads of the first column.

DESCRIPTION OF PREFERRED EMBODIMENT(S)

Figure 1:
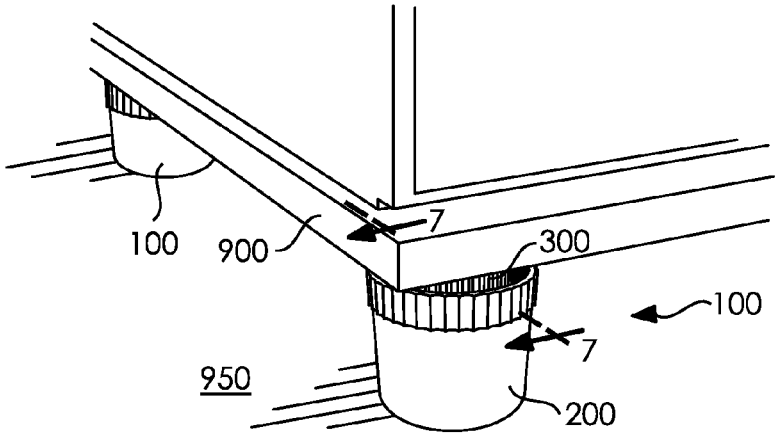
FIG. 1 provides a perspective view of an embodiment of an adjustable foot mounted to a piece of furniture.

Described herein, among other things, are adjustable foot supports for furniture that support significant amounts of weight, are inexpensive to manufacture and are easily adjustable. The foot supports generally comprise two separate housing pieces with screw-threaded columns within each of the housings. When connected, the two housings form a foot support that can be mounted to a piece of furniture, with the height of the foot supports easily adjusted by simply twisting or untwisting one of the housings relative to the other housing in order to level the piece of furniture, as described more fully below. Although the foot supports described herein are generally referred to as being attached to a piece of furniture, one of ordinary skill in the art would readily appreciate that the supports are not limited to use on cabinets, couches, tables and the like and could be used on any type of equipment for which leveling is desired.

With reference to FIGS. 1-8, adjustable foot supports for furniture will be described according to several embodiments of the present invention. As noted above, the adjustable foot support (100) is generally comprised of two main pieces—a lower housing (200) and a mount housing (300)—and an optional third piece—a cap (400). In the depicted embodiments, lower housing (200), mount housing (300), and cap (400) are all generally cylindrically shaped. However, all three pieces, and thus the support (100), could alternatively be in the form of a different shape depending on the application. For example, the support (100) could be square shaped in order to maintain the angles of the piece of furniture and a uniform appearance of the furniture and support (100).

The adjustable foot support (100) is generally able to withstand very heavy loads. In an embodiment, the support (100) is comprised of polypropylene. Such material is much more cost effective than other prior supports, particularly those comprised of metal. Nonetheless, the support (100) could be comprised of any suitable material, including metal, for example, if increased loads must be supported. In any event, the support disclosed herein is still able to withstand 400 pounds per support.

The support (100) is placed between the piece of furniture (900) and the floor (950). As discussed more fully herein, lower housing (200) connects to mount housing (300) by means of screw threads and is adjustable lengthwise relative to mount housing (300). Lower housing (200) is the portion of the support (100) that rests on the floor (950). Also, a cap (400) can be placed over the lower housing (200). Mount housing (300), on the other hand, is the portion of the support (100) that is attached to the piece of furniture (900).

Mount housing (300) is constructed of polypropylene, although, as mentioned above, other polymeric materials could also be used. As shown, the mount housing (300) comprises a sidewall (301) connected to an end wall (302) to form a hollow space. The sidewall (301) is also fluted (i.e., it has shallow grooves and ribs running vertically along the surface). Although by no means necessary, this fluting is designed to match the fluting of the lower housing (200) (which, as discussed more fully below, allows for easy grip of the lower housing (200) to assist with adjusting the height of the support (100)). Moreover, the sidewall (301) serves to hide the threaded column (304), discussed below, such that the unsightly threaded portion is not visible when the support (100) is assembled.

A column (304) is positioned within the hollow space of the mount housing (300). In this embodiment, the column (304) is positioned in the center of the mount housing (300) and spaced apart from the sidewall (301). Additionally, the column (304) extends from the end wall (302) and beyond the sidewall (301) lengthwise. In other words, the length of the column (304) is greater than the length of the sidewall (301) in the depicted embodiment. This is by no means necessary; however, as discussed more fully below, such a configuration advantageously allows for the exterior lower housing (200) to partially encase or enclose the mount housing (300) when connected (i.e., the mount housing (300) is positioned within the internal space of the lower housing (200)). As a result, neither of the threaded columns ((304) and (204)) are visible when the support (100) is expanded or compressed.

The sidewall (301), end wall (302), and column (304) are generally integrally formed together—through, e.g., injection molding—although such formation is by no means necessary. For example, the column (304) could be constructed of a different material than the sidewall (301) and/or end wall (302) and glued or welded to the end wall (302).

In this embodiment, the column (304) of the mount housing (300) is hollow and cylindrically shaped. The interior surface of the column (304) has female screw threads (305) thereon. Alternatively, the column (304) could be solid and the exterior surface of the column (304) could have male screw threads thereon. As discussed below, however, the hollowness of the column (304) assists with mounting the mount housing (300) to the piece of furniture (900). In the depicted embodiments, the screw threads (305) extend substantially but not entirely the length of the column (304). This is by no means necessary; alternatively, the screw threads could extend less of the length of the column (304) or the entire length of column (304). Also, the acme threading depicted has five (5) teeth per inch and teeth length of approximately 1.25 inches, but other threading and density and length of teeth could be used depending on the amount of support needed. The acme threading disclosed and used herein, however, is very resistant to striping, can support heavy loads, and can easily be adjusted.

The end wall (302) of the mount housing (304) connects to the column (304) and, as noted above, is integrally formed therewith (e.g., injection molding and generally the same shape as the column (304)—cylindrical or circular in this embodiment). The end wall (302) serves as a mounting surface to mount the mount housing (304) to the piece of furniture (900). In this regard, the end wall (302) is configured to be attached to the piece of furniture (900). Generally, the end wall (302) is mounted externally to the piece of furniture (900) at each of the four corners of the furniture (900). This effectively allows for a stable, level piece of furniture (900). For example, the support (100) could be mounted to the bottom platform of a cabinet or couch.

In the depicted embodiment, this mounting configuration comprises three mounting holes ((311), (312), and (313)). Two of the holes ((312) and (313)—referred to herein as "flange holes") are located on flanges ((322) and (323)), with the flanges ((322) and (323)) extending generally perpendicularly off the side wall (302). The third hole (311)—referred to herein as "center hole"—in the depicted embodiments is located in the center of the column (304). Screws (600) are then generally used in the three holes to attach the mount housing (304) to the piece of furniture (900). Since the column (304) is hollow in the depicted embodiment, a screw driver can pass through the column in order to screw the screw (600) in the center hole (311). It should be noted that although screws are discussed herein for mounting, this disclosure is not limited to screw mounting only, but can be any mounting method known to those of ordinary skill in the art, such as, but not limited to, a molded dowel, nails, fasteners, glue, welding, or the like.

In the depicted embodiments, each of the flange holes ((312) and (313)) are spaced approximately 32 millimeters (($d_1$) and ($d_2$)) apart from the center hole (311), with the flange holes ((312) and (313)) forming a 90 degree angle relative to the center hole (311). This configuration is by no means necessary; however, it allows attachment of the mount housing (300) by drilling to be done on high speed European 32-mm boring machines.

As discussed above, the lower housing (200) is threadably connected to the mount housing (300), allowing for a range of height adjustments for the support (100) to effectively level a piece of furniture (900). Moreover, the lower housing (200) can effectively act as a glide when sliding the furniture over a variety of surfaces, such as carpet, wood floors, tile and other similar surfaces. Like the mount housing (300), lower housing (200) is similarly constructed of polypropylene, although, as mentioned above, other polymeric materials could also be used. As shown, the lower housing (200) comprises a sidewall (201) connected to an end wall (202) which define an interior hollow space within the lower housing (200) and an opening (203) at the top of the lower housing (200).

Figure 2:
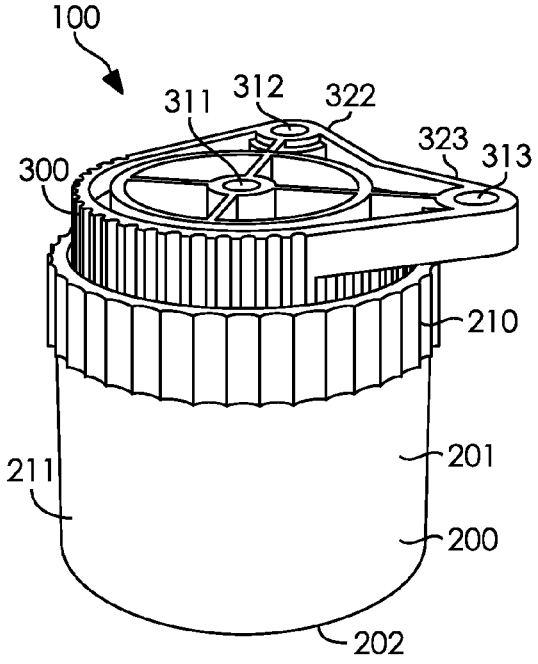
FIG. 2 provides an isometric perspective view of an embodiment of an adjustable foot in a compressed position.
Figure 2A:
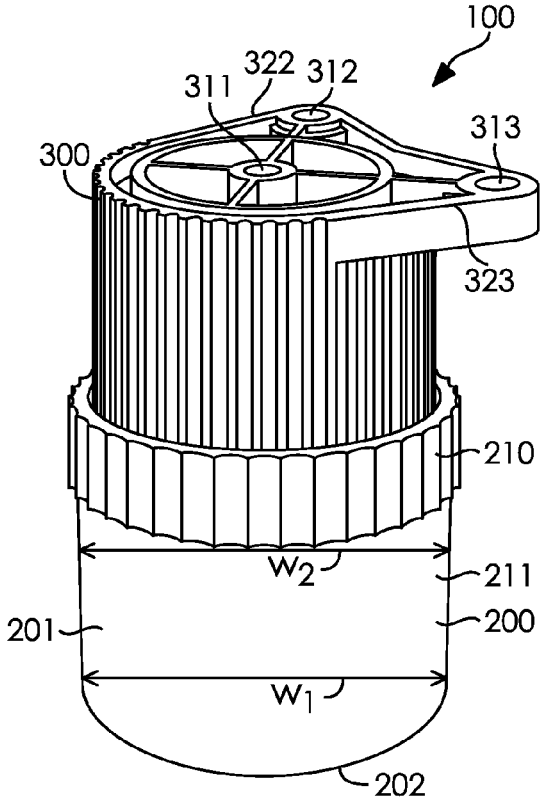
FIG. 2A provides an isometric perspective view of an embodiment of an adjustable foot in an expanded position.
Figure 3:
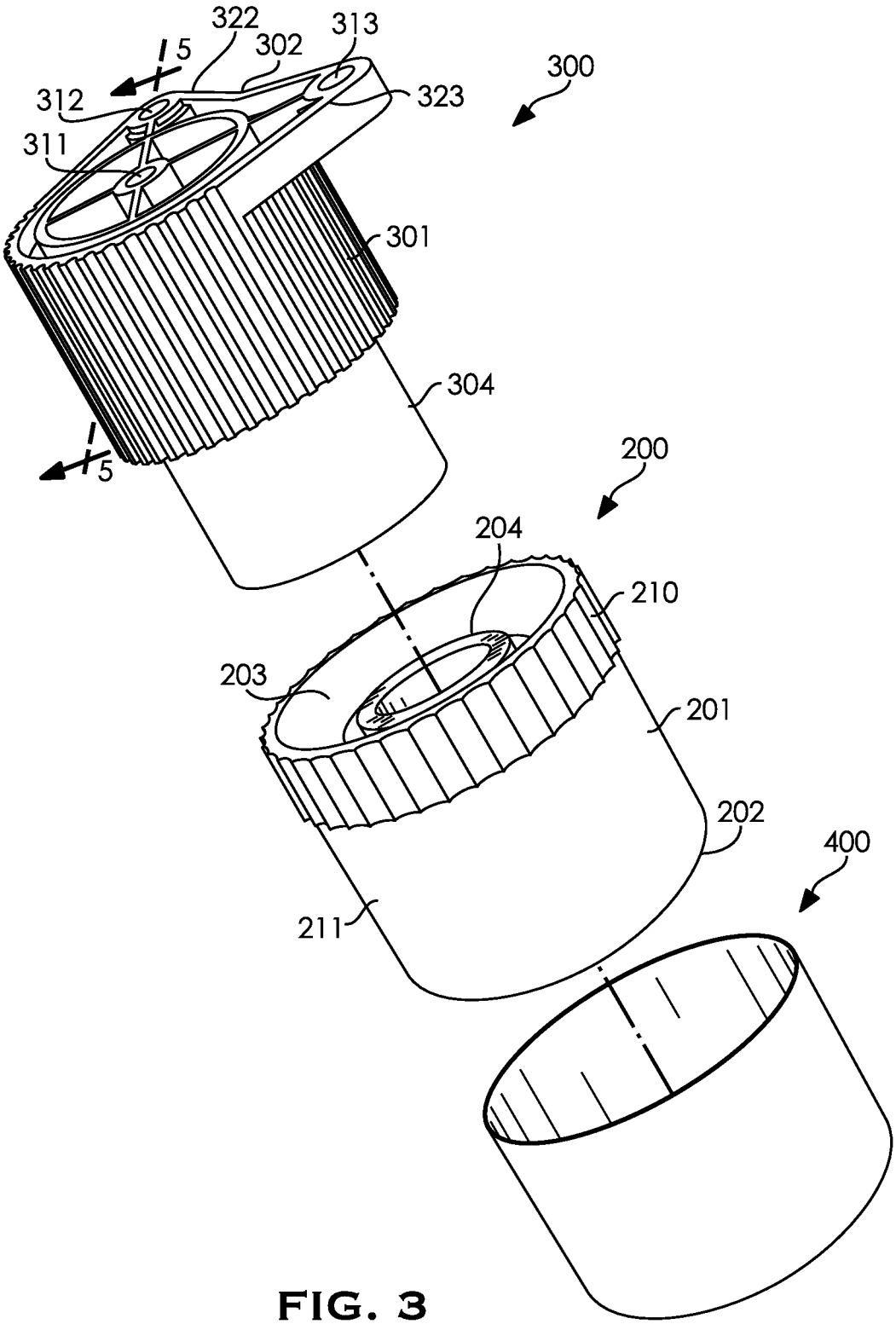
FIG. 3 is an exploded perspective view of the adjustable foot assembly with a cap included.
Figure 4:
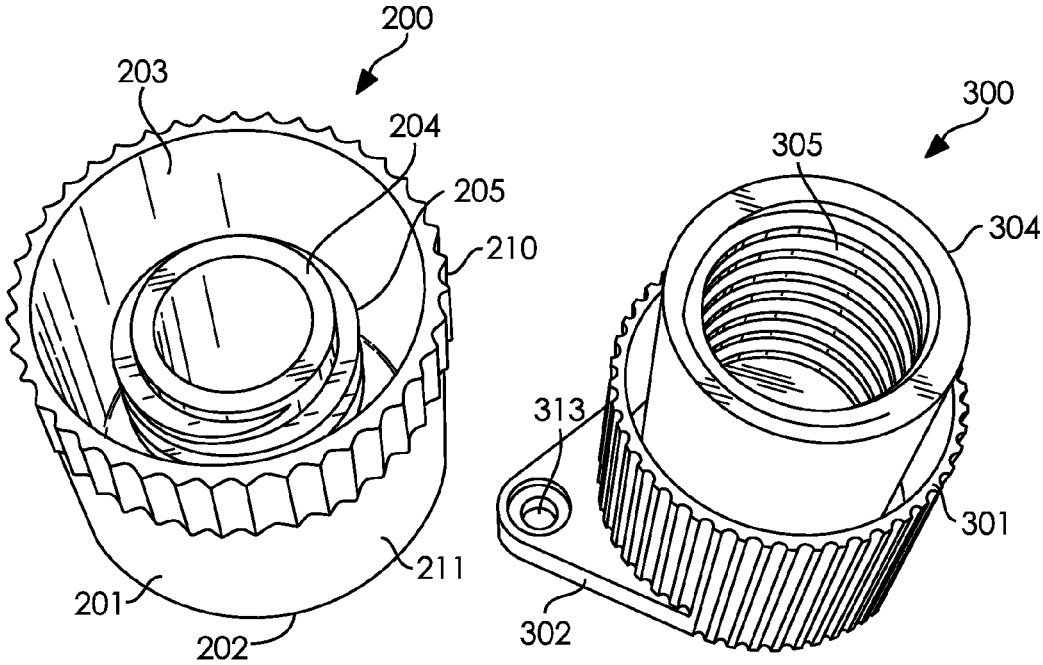
FIG. 4 is a perspective view of the mount housing and lower housing in one embodiment of the adjustable foot.
Figure 5:
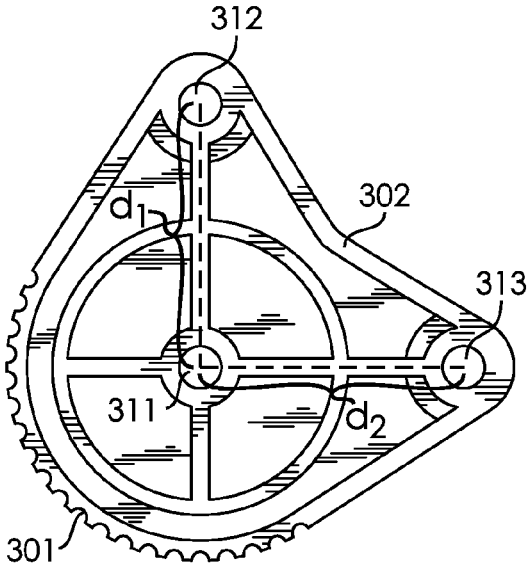
FIG. 5 is a top view of the mount housing in one embodiment of the adjustable foot.
Figure 6:
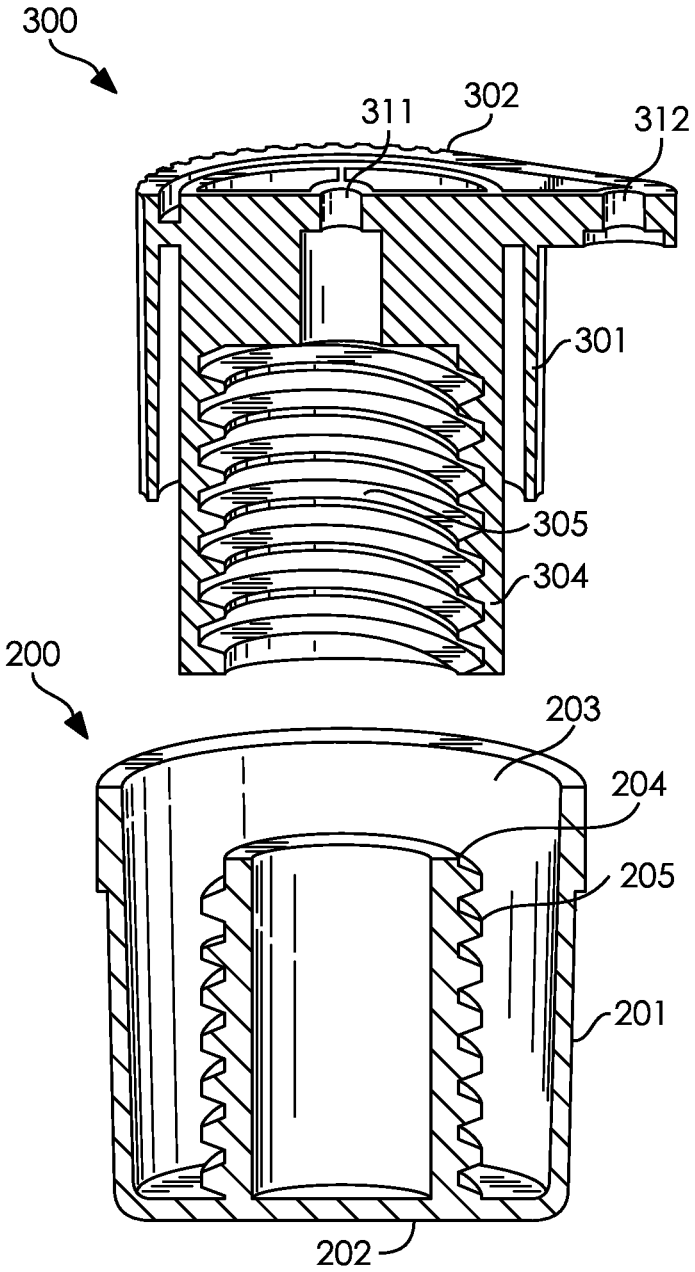
FIG. 6 is a cross-sectional exploded view of an embodiment of the adjustable foot taken along line 5 in FIG. 3.
Figure 7:
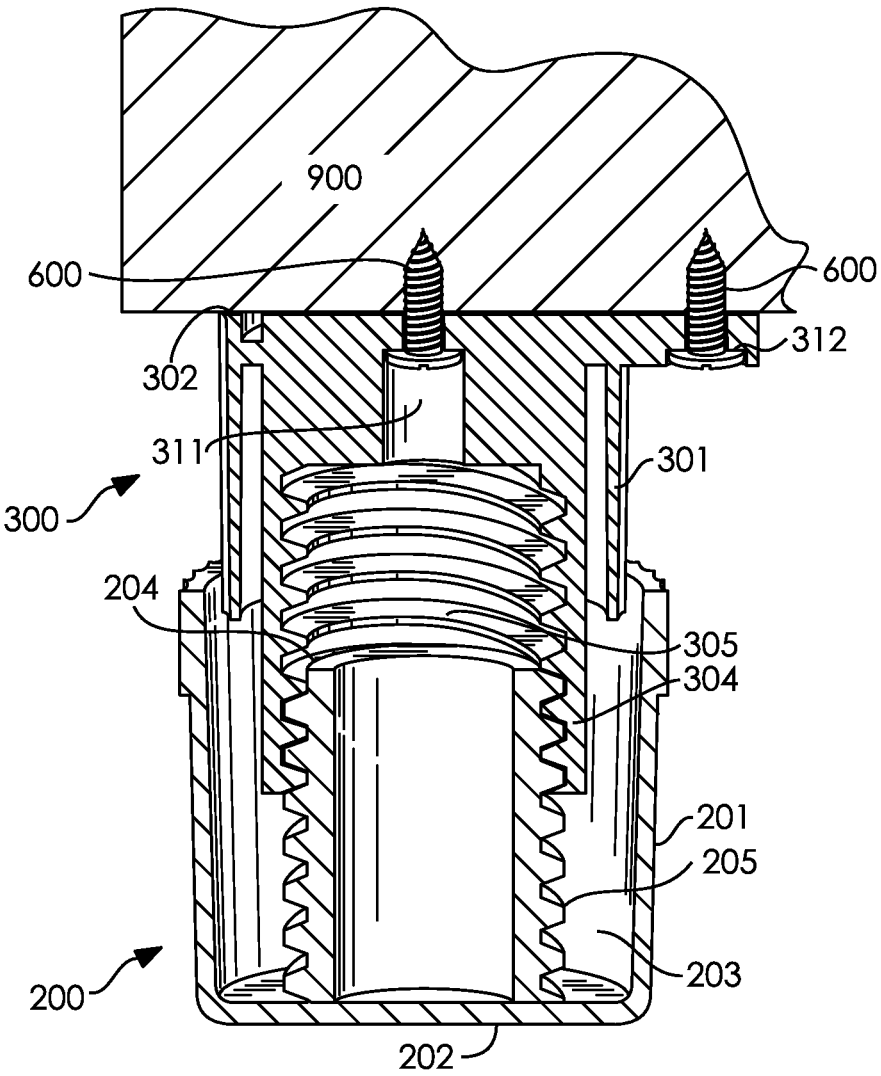
FIG. 7 is a cross-sectional exploded view of an embodiment of the adjustable foot taken along line 7 in FIG. 1 with the foot in the expanded position.

The upper section (210) of the sidewall (201) is fluted in the depicted embodiments to match the fluted sidewall (301) of the mount housing (300). Such fluting is by no means necessary; however, this fluting allows for an easy handgrip of the lower housing (200) to connect to the mount housing (300) and to adjust the height of the support (100). Thus, no tools are needed and a user can easily adjust the support (100) from an expanded position, see FIG. 2A, to a compressed position, see FIG. 2, and vice versa.

The lower section (211) of the sidewall (201) is smoother than the upper section (210) and is designed and configured to accept a cap (400). The cap (400) is similarly injection molded. The lower housing (200) is tapered (i.e., the width ($w_1$) near the end wall (202) is shorter than the width ($w_2$) near the fluted upper section (210)), and as a result, the cap (400) can be help in place by friction between tapered nature of the lower housing (200) and the interior of the cap (400). Additionally, the cap (400) can be a wide variety and range of colors; for example, the cap (400) could be colored to match a wood grain if needed or desired. Although the cap (400) is by no means necessary, it advantageously protects the lower housing (200), acts as a further glide when moving furniture, and allows for a color scheme that allows the support (100) to match the color of the piece of furniture (900), the floor, or any other associated objects.

A column (204) is positioned within the interior space of the lower housing (200). In this embodiment, the column (204) is positioned in the center of the lower housing (200) and spaced apart from the sidewall (201). Additionally, the column (204) extends from the end wall (202). The sidewall (201), end wall (202), and column (204) are generally integrally formed together—through, e.g., injection molding—although such formation is by no means necessary. For example, the column (204) could be constructed of a different material than the sidewall (201) and/or end wall (202) and glued or welded to the end wall (202).

In this embodiment, the column (204) of the mount housing (200) is hollow and cylindrically shaped. The exterior surface of the column (204) has male screw threads (205) thereon to mate with the screw threads (305) of the lower housing (300). Alternatively, the interior surface of the column (204) could have female screw threads thereon. Whether the column (204) of the mount housing (200) has male or female threads is not important; what is important is that the threads are different from the threads on the column (304) of the lower housing (300) (in other words, one column will have male threads and the other column will have female threads).

In the depicted embodiments, the screw threads (205) extend nearly the entire length of the column (204). This is by no means necessary; alternatively, the screw threads could extend less of the length of the column (204). Again, the acme threading utilized has five (5) teeth per inch and teeth length of approximately 1.25 inches, but other threading and density and length of teeth could be used depending on the amount of support needed. Again, however, the acme threading disclosed and used herein is very resistant to striping, can support heavy loads, and can be easily adjusted. In any event, the thread (205) of the column (204) should be of the same type (e.g., density and length) as, and configured to be mated with, the thread (305) of the column (304) of the mount housing (300)

The thread mating compatibility of the threads (205) of the lower housing (200) with the threads (305) of the mount housing (300) allows the lower housing (200) to be connected to the mount housing (300) and permits the lower housing (200) to adjust lengthwise (e.g., up or down, depending on which direction the lower housing (200) is turned). As a result, the height of support (100) can be adjusted, thereby changing the elevation of the piece of furniture (900) to which the support (100) is attached. Moreover, the sidewall (201) of the lower housing (200) partially encases or encloses the mount housing (300) when connected (i.e., the mount housing (300) is positioned within the internal space of the lower housing (200)). This configuration allows for a large range of adjustable heights of the support (100) with easy adjustment because the piece being adjusted, the lower housing (200), is always and easily accessible. This thus allows for efficient leveling of the piece of furniture (900). Moreover, when the support (100) is either fully compressed or fully expanded, the columns ((204) and (304)) and the threading thereon ((205) and (305)) are not visible.

Figure 8:
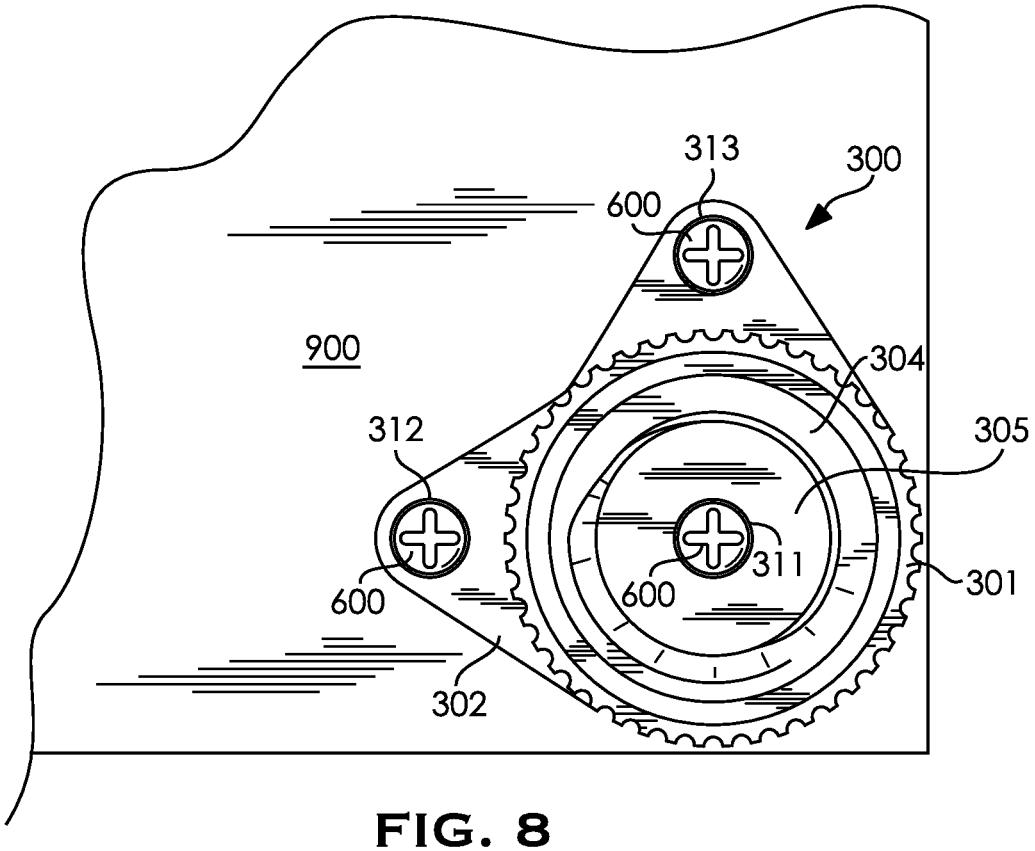
FIG. 8 is a plan view of the bottom of the mount housing attached onto the corner of a piece of furniture.

To use and adjust the support (100), the mount housing (300) is first mounted to a piece of furniture (900), preferably at each of the four corners of the furniture (900). The mount housing (300) is secured to the furniture (900) by placing screws, nails, or the like in each of the three mount holes ((311), (312), and (313)). The flanged mounting holes ((312) and (313)) are generally placed on the sides of the furniture (900), with the center mounting hole (311) placed nearest the corner of the furniture (900), as shown in FIG. 8. For the center mounting hole (311), the screw (600) is inserted through the hollow column (304), as suggested in FIG. 7. The three screws (600) are then inserted through the mount housing (300) and into the furniture (900) (e.g., into a platform or flat portion of the furniture), such that the support (100) is mounted external to the furniture (900). With the mount housing(s) (300) securely in place, the lower housing(s) (200) are then adjustably secured to the mount housing (300). To do so, one would insert the lower housing (200) over the mount housing (300) so that the lower housing (200) threaded column (204) mates with the mount housing (300) threaded column (304). Then, one would grasp the lower housing (200), preferably at the fluted section (210) for added gripability and avoidance of slippage, and twist in a clockwise direction to compress the support (100) and adjust to the desired length. Similarly, the lower housing (200) could be twisted in a counterclockwise direction to expand the support (100). In an alternative embodiment, the lower housing (200) is twisted counterclockwise to compress the support (100) and clockwise to expand the support (100). Moreover, tools could be used to twist the lower housing (200), and thereby expand and compress the support (100), although tools are by no means necessary to adjust the support (100). A cap (400) can then be inserted over the lower housing (200). This cap (400) is by no means necessary; but as discussed more fully above, it assists with gliding furniture and allows for color variations for the support (100).

Although not described in detail, numerous other embodiments are possible in accordance with the present invention. Several different of these embodiments are shown and depicted herein.

Taken together, the foot support disclosed herein provides new opportunities for leveling furniture at an efficient cost. First, because the foot support may be comprised of polypropylene, it can be efficiently manufactured at a price much lower than conventional supports comprised of metal. Second, the support is able to withstand very heavy loads, including up 400 pounds per support, even when constructed of polypropylene. Third, the configuration of the mount housing and lower housing allows for easy adjustment of the foot support. Specifically, the lower housing partially encloses the mounting housing and thus allows for the piece used for adjusting (i.e., the lower housing) to be on the outside of the support. Finally, because of the dual housing (i.e., the lower housing and mount housing) configuration, neither the columns nor the threads thereon are visible from the outside, resulting in an aesthetically pleasing support.

While the invention has been disclosed in conjunction with a description of certain embodiments, including those that are currently believed to be the preferred embodiments, the detailed description is intended to be illustrative and should not be understood to limit the scope of the present disclosure. As would be understood by one of ordinary skill in the art, embodiments other than those described in detail herein are encompassed by the present invention. Modifications and variations of the described embodiments may be made without departing from the spirit and scope of the invention.

The invention claimed is:

1. An adjustable foot support for furniture, the adjustable foot comprising:

a lower housing comprising a sidewall and an end wall connected to the sidewall, the sidewall and end wall defining an internal space of the lower housing;

a first column positioned within the internal space and extending from the end wall of the lower housing, the first column being spaced apart from the sidewall of the lower housing, the first column having screw threads thereon;

a mount housing configured to be attached to a piece of furniture, the mount housing comprising a sidewall, an end wall connected to the sidewall, and at least three mount holes on the end wall of the mount housing; and a second column positioned within the mount housing and extending from the end wall of the mount housing, the second column spaced apart from the sidewall of the mount housing, the second column having screw threads sized and shaped to mate with the screw threads of the first column, and the second column being hollow and defining an internal space of the second column, at least one of the at least three mount holes extending into the internal space of the second column.

2. The adjustable foot of claim 1 wherein the distance between the first mounting hole and the second and third mounting holes is approximately 32 millimeters.

3. The adjustable foot of claim 1 wherein the mount housing is positioned within the internal space of the lower housing when the screw threads of the second column are mated with the screw threads of the first column.

4. The adjustable foot of claim 1 wherein the lower housing, first column, mounting housing, and second column are constructed of a polymeric material.

5. The adjustable foot of claim 1 wherein the threads of the first column are on the exterior of the first column.

6. The adjustable foot of claim 5 wherein the threads of the second column are on the interior of the second column.

7. The adjustable foot of claim 1 wherein the first column is shorter than the sidewall of the lower housing.

8. The adjustable foot of claim 1 wherein the second column is longer than the sidewall of the lower housing.

9. The adjustable foot of claim 1 further comprising at least one flange extending from the end wall of the mount housing generally perpendicular to the sidewall of the mount housing.

10. The adjustable foot of claim 9 wherein at least one of the at least three mount holes extends through at least one of said at least one flange.

11. The adjustable foot of claim 1 wherein the lower housing is tapered with the diameter at the end wall greater than the diameter of the opening of the lower housing.

12. The adjustable foot of claim 11 further comprising a cap configured to be removably attached to the lower housing.

* * * * *